US012722070B2

(12) United States Patent
Crichton et al.

(10) Patent No.: US 12,722,070 B2
(45) Date of Patent: Sep. 1, 2026

(54) SKATE

(71) Applicant: Stateside Skates Ltd., London (GB)

(72) Inventors: Alistair Crichton, Farnborough (GB); Jacob Bach Vorre, Aarhus (DK); Helen Capewell, Amersham (GB)

(73) Assignee: STATESIDE SKATES LTD., Amersham (GB)

( * ) Notice: Subject to any disclaimer, the term of this patent is extended or adjusted under 35 U.S.C. 154(b) by 288 days.

(21) Appl. No.: 18/656,936

(22) Filed: May 7, 2024

(65) Prior Publication Data

US 2025/0345696 A1 Nov. 13, 2025

(51) Int. Cl.
*A63C 17/08* (2006.01)

(52) U.S. Cl.
CPC ..... *A63C 17/08* (2013.01); *A63C 2203/42* (2013.01)

(58) Field of Classification Search
None
See application file for complete search history.

(56) References Cited

U.S. PATENT DOCUMENTS 5,388,846 A * 2/1995 Gierveld ..... A63C 17/006 280/11.27
5,549,310 A * 8/1996 Meibock ..... A43B 5/0401 280/11.221
6,070,886 A * 6/2000 Cornelius ..... A63C 17/226 280/809
6,113,123 A * 9/2000 Cabanis ..... A43B 5/165 280/841
6,308,965 B1 * 10/2001 Yang ..... A43B 5/1608 280/11.221
6,648,346 B2 * 11/2003 Borel ..... A43B 5/1633 280/11.26
6,837,500 B2 * 1/2005 van Egeraat ..... A63C 17/067 280/11.221
6,916,027 B2 * 7/2005 Chen ..... A43B 3/26 280/11.26
6,955,361 B2 * 10/2005 Borel ..... A43B 5/0421 280/11.26
11,439,888 B2 * 9/2022 Altshuler ..... A63C 1/42
2001/0013695 A1 * 8/2001 Borel ..... A43B 5/0403 280/607

(Continued)

FOREIGN PATENT DOCUMENTS

EP 1175926 A1 * 1/2002 ..... A63C 1/22
WO WO-0047295 A1 * 8/2000 ..... A63C 17/0086

*Primary Examiner* — James A Shriver, II
*Assistant Examiner* — Ian Bryce Shelton
(74) *Attorney, Agent, or Firm* — MUNCY, GEISSLER, OLDS & LOWE, P.C.

(57) ABSTRACT

A skate is provided, wherein the skate includes: a boot including a body portion and a sole, an inner surface of the sole including a recess which is X-shaped, the recess including four grooves, each of the four grooves including a first positioning structure; a metal member being X-shaped and including four arms, each of the four arms being received in one of the four grooves and including a second positioning structure, the second positioning structure of each of the four arms being positioned to the first positioning structure of one of the four grooves; a roller assembly including a frame and a plurality of rollers disposed on the frame, the frame being connected to the sole; and a plurality of fasteners securing the frame to the sole.

10 Claims, 9 Drawing Sheets

(56) References Cited

U.S. PATENT DOCUMENTS

| | | | | |
|---|---|---|---|---|
| 2003/0201614 | A1* | 10/2003 | Chi | A43B 5/1633 280/11.3 |
| 2004/0056436 | A1* | 3/2004 | Borel | A43B 5/0403 280/11.3 |
| 2004/0222602 | A1* | 11/2004 | van Egeraat | A63C 17/067 280/11.27 |
| 2008/0246235 | A1* | 10/2008 | Alexander | A63C 17/0046 280/11.225 |
| 2015/0048578 | A1* | 2/2015 | Knoll | A63C 17/02 280/11.27 |
| 2025/0135319 | A1* | 5/2025 | Knoll | A63C 17/067 |

* cited by examiner

SKATE

BACKGROUND OF THE INVENTION

Field of the Invention

The present invention relates to a kind of sports equipment, and especially to a skate.

Description of the Prior Art

Skate is a very common and popular entertainment and sports equipment. With rollers mounted on a sole it allows the user to move quickly, thereby achieving entertainment, sports exercise, and/or competition.

Generally speaking, a skate includes a boot and a roller assembly, and the roller assembly is secured to the bottom of the boot through fasteners. In a kind of roller assembly of a conventional skate, a frame with rollers is connected to a connection plate, and the connection plate is secured to the bottom of the boot by fasteners. In this conventional structure, nuts or washers are usually provided in the boot to lock with the fasteners so that the connection plate is secured to the bottom of the boot. However, this conventional structure requires many nuts or washers, which is complex and inconvenient to assemble and disassemble. Besides, the nuts or washers are separated and independently arranged, resulting in poor overall structural strength, insufficient resistance to deformation and poor force transmission.

The present invention is, therefore, arisen to obviate or at least mitigate the above-mentioned disadvantages.

SUMMARY OF THE INVENTION

The main object of the present invention is to provide a skate which is easy and quick to assemble and disassemble, can enhance the structural strength and deformation resistance, and is conducive to force transmission.

To achieve the above and other objects, a skate is provided, wherein the skate includes: a boot including a body portion and a sole, an inner surface of the sole including a recess which is X-shaped, the recess including four grooves, each of the four grooves including a first positioning structure; a metal member being X-shaped and including four arms, each of the four arms being received in one of the four grooves and including a second positioning structure, the second positioning structure of each of the four arms being positioned to the first positioning structure of one of the four grooves; a roller assembly including a frame and a plurality of rollers disposed on the frame, the frame being connected to the sole; and a plurality of fasteners securing the frame to the sole.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
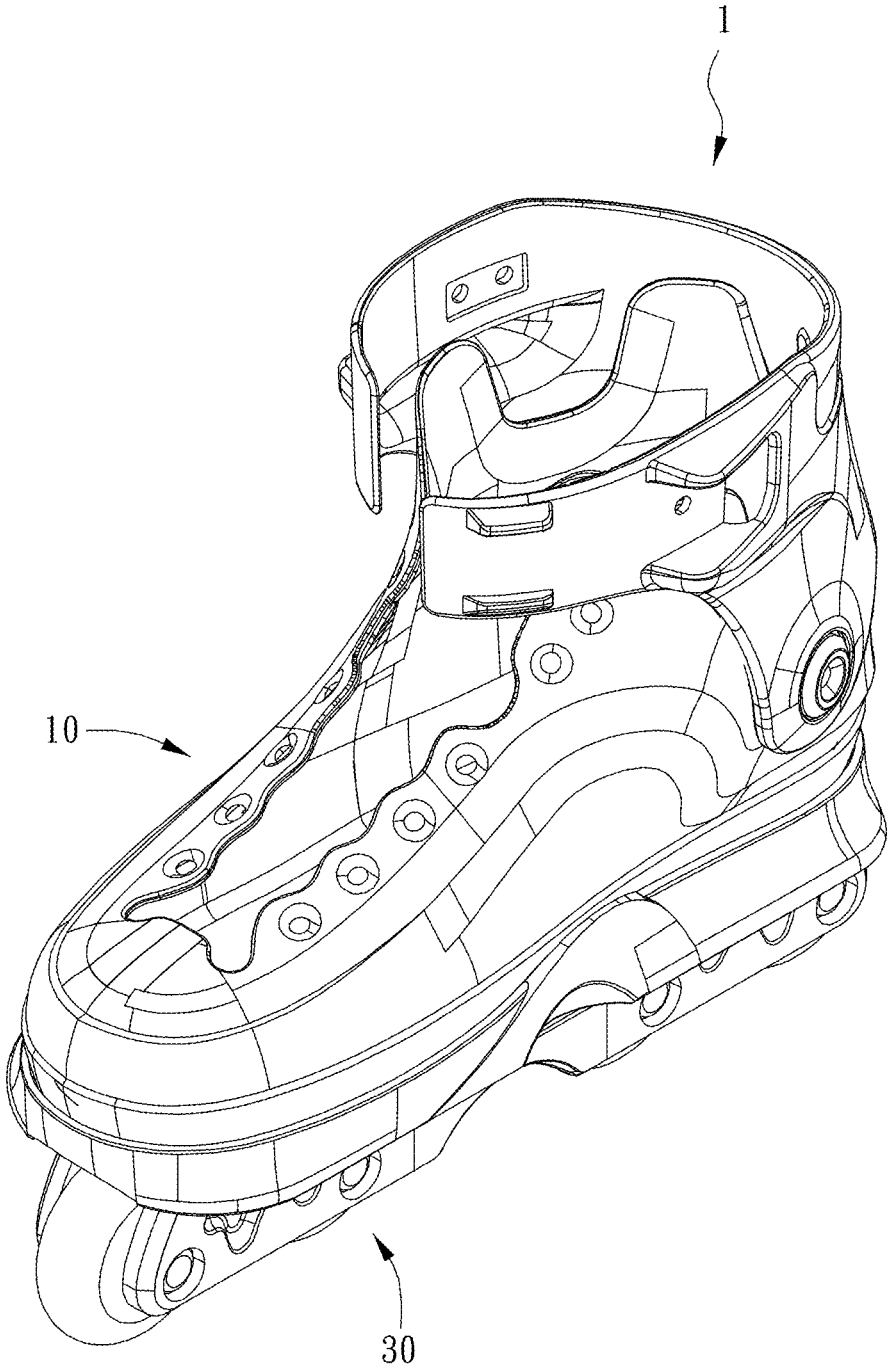
FIG. 1 is a stereogram of an exemplary embodiment of the present invention.
Figure 2:
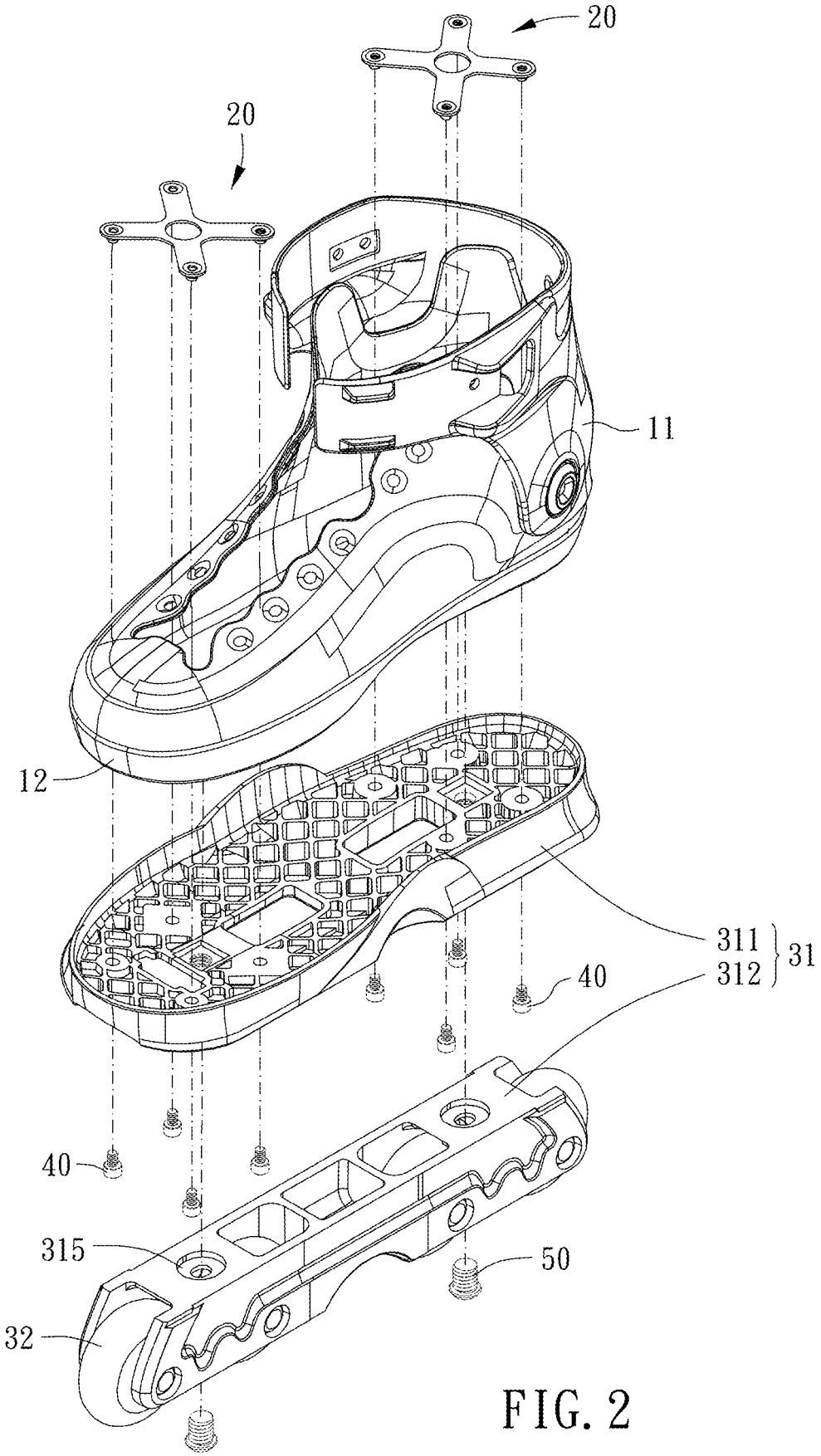
FIG. 2 is a breakdown drawing of an exemplary embodiment of the present invention.
Figure 3:
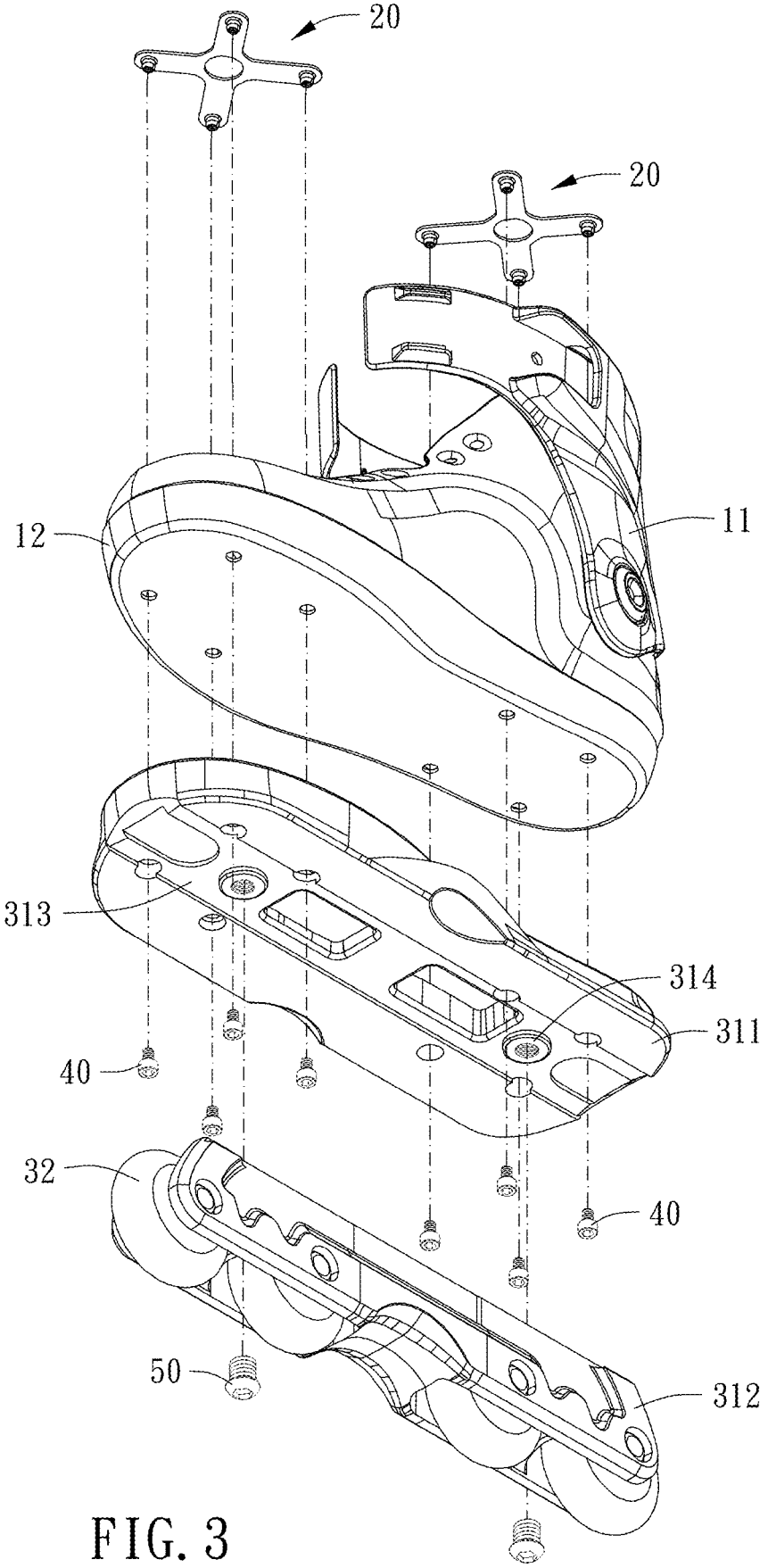
FIG. 3 is another breakdown drawing of an exemplary embodiment of the present invention.
Figure 4:
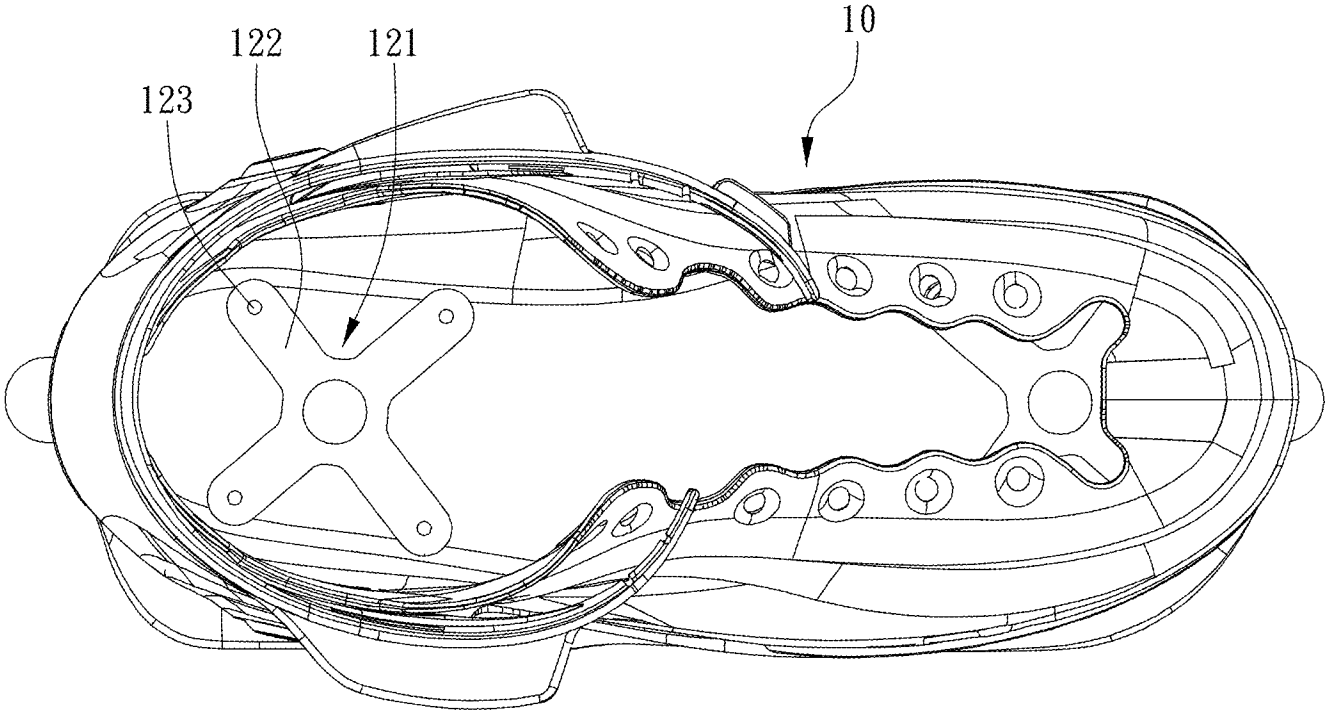
FIG. 4 is a top view of an operation member according to an exemplary embodiment of the present invention.
Figure 5:
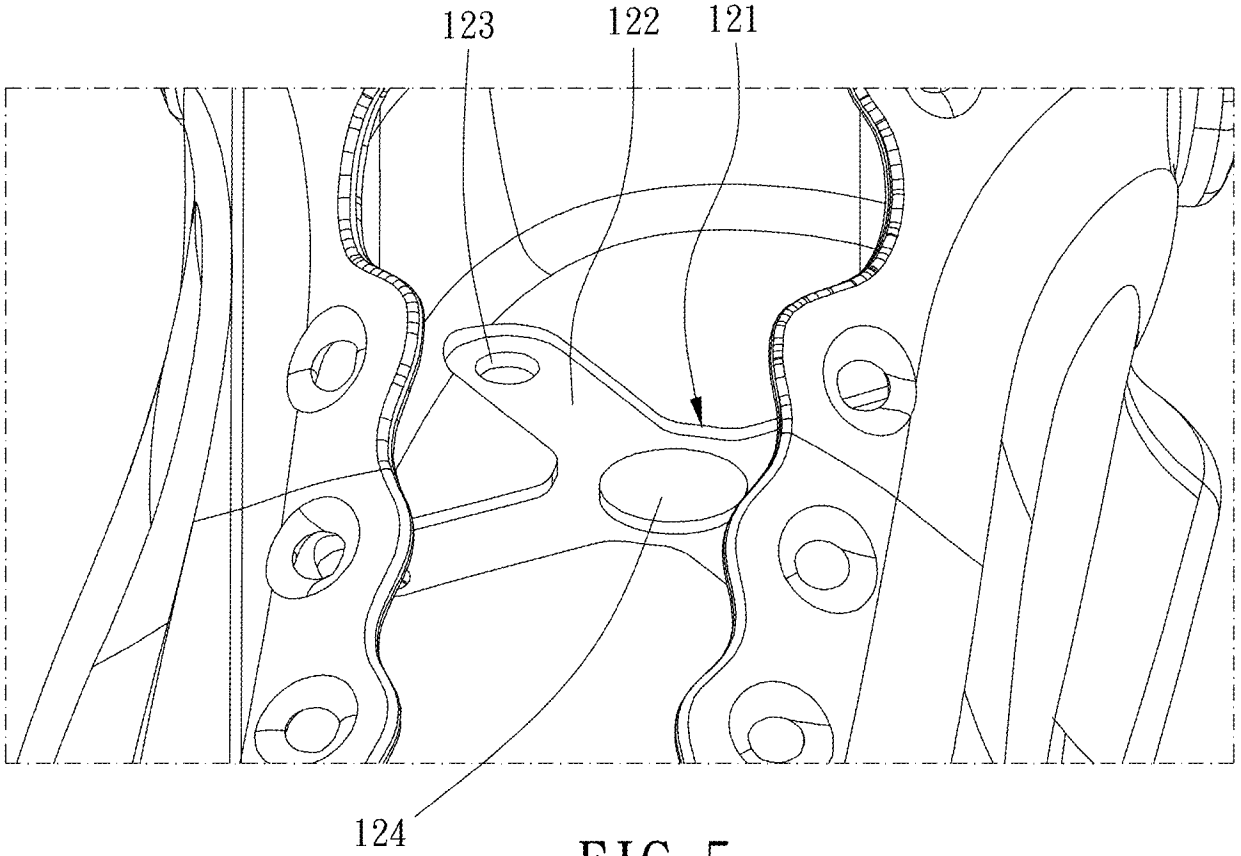
FIG. 5 is a partial stereogram of an exemplary embodiment of the present invention.
Figure 6:
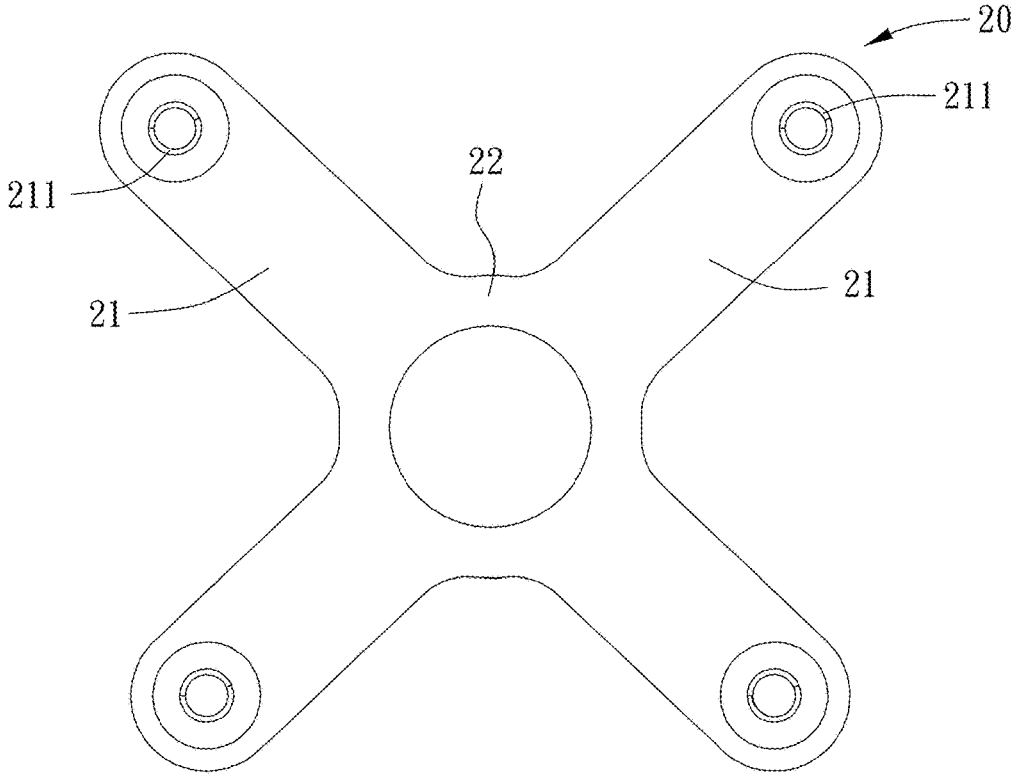
FIG. 6 is a top view of a metal member of an exemplary embodiment of the present invention.
Figure 7:
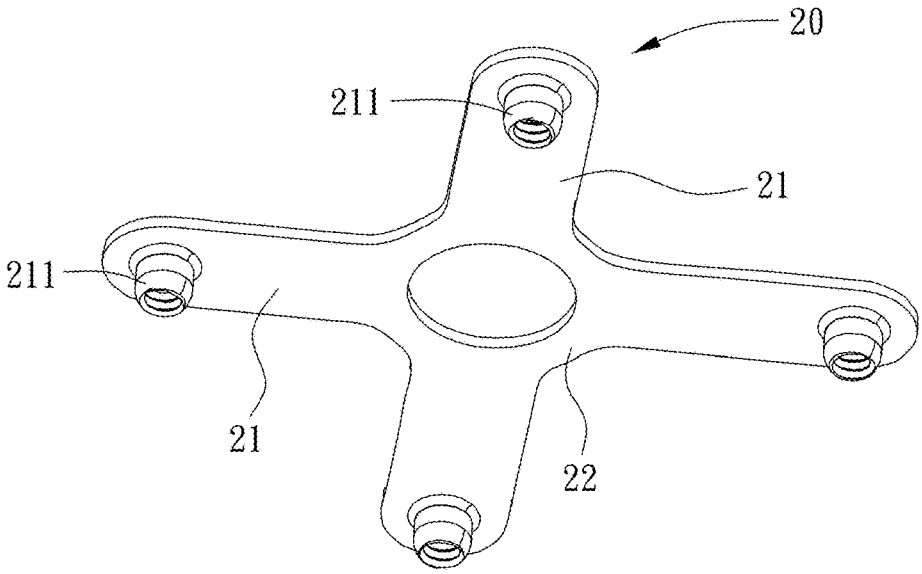
FIG. 7 is a stereogram of the metal member of an exemplary embodiment of the present invention.
Figure 8:
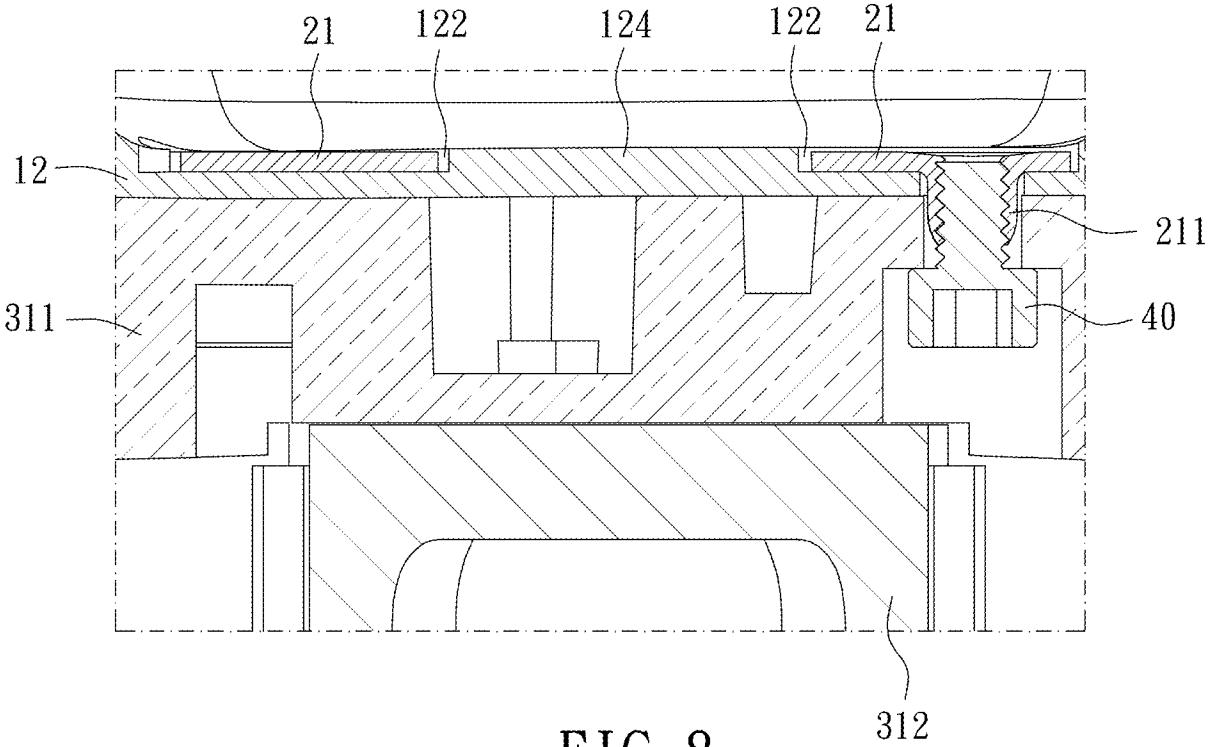
FIG. 8 is a partial enlarged cross-sectional view of an exemplary embodiment of the present invention.
Figure 9:
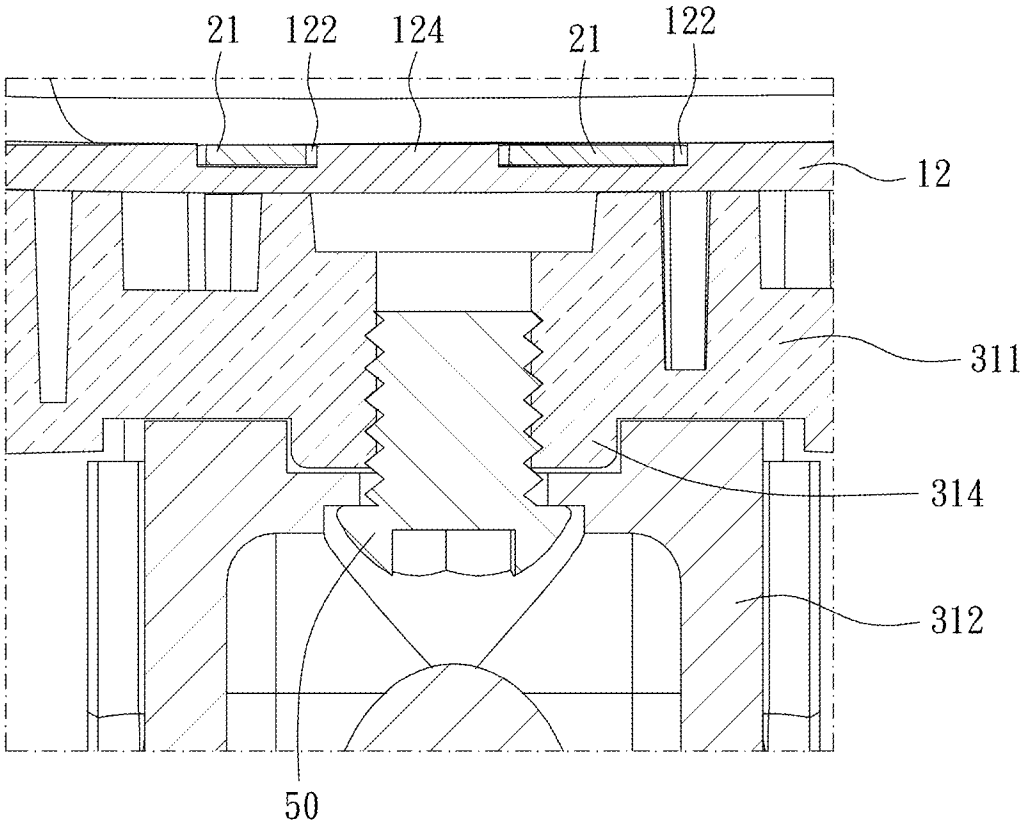
FIG. 9 is another partial enlarged cross-sectional view of an exemplary embodiment of the present invention.
Figure 10:
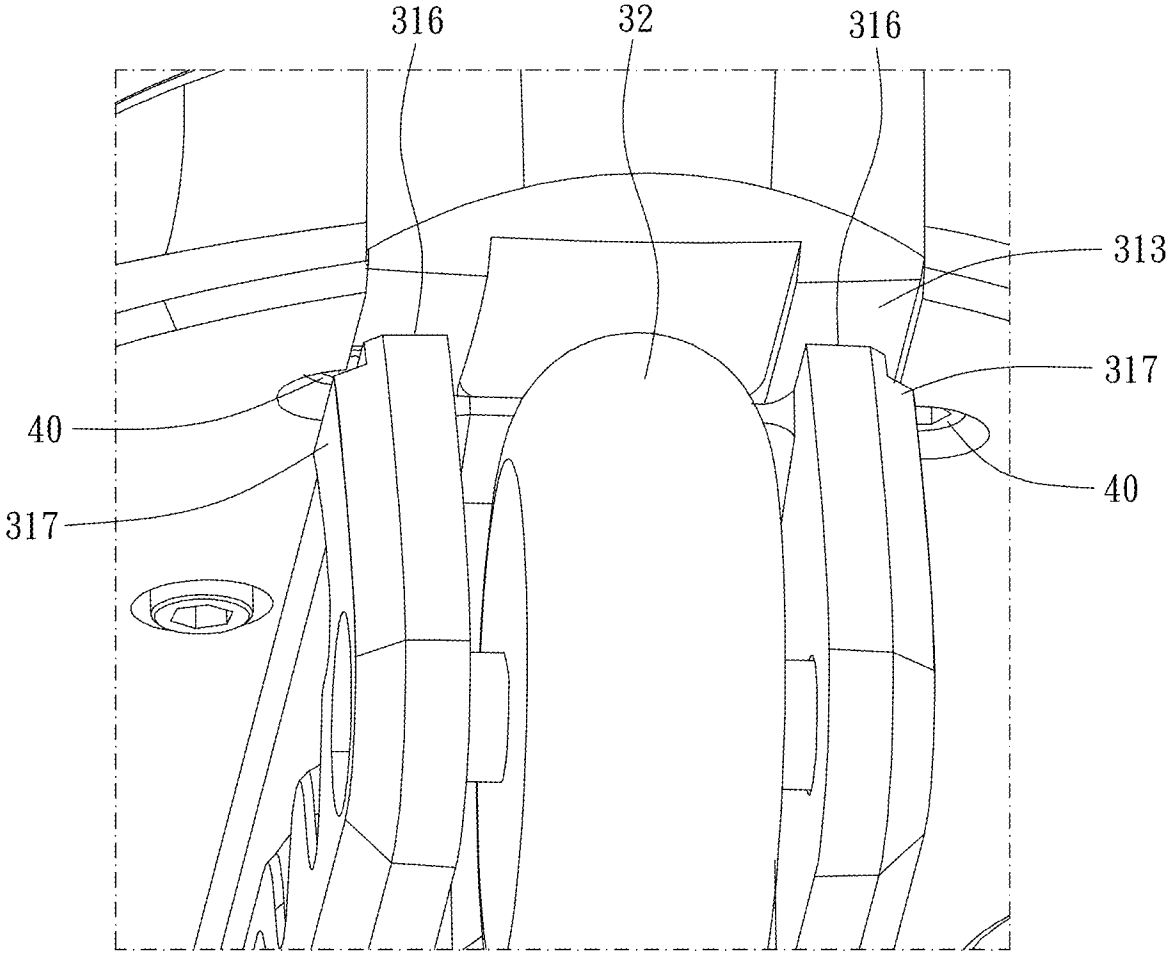
FIG. 10 is another partial stereogram of an exemplary embodiment of the present invention.

Please refer to FIGS. 1 to 10 for an exemplary embodiment of the present invention. A skate 1 of the present invention includes a boot 10, a metal member 20, a roller assembly 30 and a plurality of fasteners 40.

The boot 10 includes a body portion 11 and a sole 12, an inner surface of the sole 12 includes a recess 121 which is X-shaped, the recess 121 includes four grooves 122, and each of the four grooves 122 includes a first positioning structure 123. The metal member 20 is X-shaped and includes four arms 21, each of the four arms 21 is received in one of the four grooves 122 and includes a second positioning structure 211, and the second positioning structure 211 of each of the four arms 21 is positioned to the first positioning structure 123 of each of the four grooves 122. The first positioning structure 123 and the second positioning structure 211 are in a male-to-female connection, for example; however, the first positioning structure 123 and the second positioning structure 211 may be both holes and connected by a fastener disposed therethrough. The roller assembly 30 includes a frame 31 and a plurality of rollers 32 disposed on the frame 31, and the frame 31 is connected to the sole 12. The plurality of fasteners 40 secure the frame 31 to the sole 12. In this embodiment, the skate 1 includes two metal members 20 disposed at front and rear end portions of the boot 10. As such, the metal member 20 is easy and quick to assemble and disassemble, can enhance the structural strength and deformation resistance, and is conducive to force transmission.

Preferably, the metal member 20 is detachably disposed on the sole 12 and non-protrusive beyond (preferably flush with) the inner surface of the sole 12, thus being easily and quickly to assemble and disassemble and being comfortable in wearing. A projection 124 is disposed in the recess 121, the four grooves 122 extend radially form the projection 124, the metal member 20 further includes an annular portion 22, the four arms 21 extend radially form the annular portion 22, and the annular portion 22 is disposed around the projection 124, wherein the annular portion 22 is conducive to installation of the metal member 20 and conducive to dispersion and transmission of force. The projection 124 may be circular or non-circular, the projection 124 is conducive to quick and precise installation of the metal member 20, and the projection 124 also enhances the stability and structural strength of the combination, and enhances deformation resistance of the sole 12 and force transmission.

In this embodiment, the four arms 21 are equiangularly arranged, and the four arms 21 are non-parallel to a longitudinal direction of the sole 12, which provides good support in a lateral direction and good resistance to twisting; however, the four arms 21 may be arranged in different angles. Preferably, the second positioning structure 211 of each of the four arms 21 is integrally formed as a part of the metal member 20, which is fast to manufacture and provides good structural strength; however, the second positioning structure 211 may be additionally connected to the arm 21. The second positioning structure 211 of each of the four arms 21 is a tubular member, an inner surface of the tubular member is threaded, and each of the plurality of fasteners 40 is screwed to the second positioning structure 211 of one of the four arms 21. The tubular member provides the fastener 40 with a large screw connection range and more reliable assembly strength; however, the plurality of fasteners 40 may be connected by riveting.

Specifically, the frame 31 includes a connection plate 311 and a rail 312, the metal member 20 and the connection plate 311 are secured to opposing sides of the sole 12 by the plurality of fasteners 40, the rail 312 is connected to the connection plate 311, the plurality of rollers 32 are disposed on the rail 312, the connection plate 311 includes a longitudinal slot 313, and the rail 312 is engaged in the longitudinal slot 313. The connection plate 311 may be made of metal or hard plastic material with sufficient strength, and the rail 312 is preferably made of metal with greater structural strength. A plurality of protrusions 314 are disposed on a bottom of the longitudinal slot 313, the rail 312 includes a plurality of mounting holes 315, the plurality of protrusions 314 are respectively received in the plurality of mounting holes 315, which is conducive to quick and precise installation of the rail 312, enhances the stability and structural strength of the combination, enhances the structural strength and deformation resistance, and is conducive to force transmission. A plurality of fixation members 50 are disposed through the plurality of mounting holes 315 and the plurality of protrusions 314 and secure the rail 312 to the connection plate 311. Preferably, the rail 312 includes an engaging portion 316 and two shoulders 317, the engaging portion 316 is engaged in the longitudinal slot 313, the two shoulders 317 are respectively disposed at opposing sides of the engaging portion 316, and in a width direction of the sole 12 each of the two shoulders 317 extends beyond the longitudinal slot 313 and shields at least part of the plurality of fasteners 40, which provides good stability and structural strength of the combination, and prevents the fastener 40 from external impact or/and damage.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A skate including:

a boot including a body portion and a sole, an inner surface of the sole including a recess which is X-shaped, the recess including four grooves, each of the four grooves including a first positioning structure;

a metal member being X-shaped and including four arms, each of the four arms being received in one of the four grooves and including a second positioning structure, the second positioning structure of each of the four arms being positioned to the first positioning structure of one of the four grooves;

a roller assembly including a frame and a plurality of rollers disposed on the frame, the frame being connected to the sole; and a plurality of fasteners securing the frame to the sole.

2. The skate of claim 1, wherein the metal member is detachably disposed on the sole and non-protrusive beyond the inner surface of the sole.

3. The skate of claim 1, wherein a projection is disposed in the recess, the four grooves extend radially form the projection, the metal member further includes an annular portion, the four arms extend radially form the annular portion, and the annular portion is disposed around the projection.

4. The skate of claim 1, wherein the four arms are equiangularly arranged.

5. The skate of claim 1, wherein the four arms are non-parallel to a longitudinal direction of the sole.

6. The skate of claim 1, wherein the second positioning structure of each of the four arms is integrally formed as a part of the metal member.

7. The skate of claim 6, wherein the second positioning structure of each of the four arms is a tubular member, an inner surface of the tubular member is threaded, and each of the plurality of fasteners is screwed to the second positioning structure of one of the four arms.

8. The skate of claim 1, wherein the frame includes a connection plate and a rail, the metal member and the connection plate are secured to opposing sides of the sole by the plurality of fasteners, the rail is connected to the connection plate, the plurality of rollers are disposed on the rail, the connection plate includes a longitudinal slot, and the rail is engaged in the longitudinal slot.

9. The skate of claim 8, wherein a plurality of protrusions are disposed on a bottom of the longitudinal slot, the rail includes a plurality of mounting holes, the plurality of protrusions are respectively received in the plurality of mounting holes, and a plurality of fixation members are disposed through the plurality of mounting holes and the plurality of protrusions and secure the rail to the connection plate.

10. The skate of claim 8, wherein the rail includes an engaging portion and two shoulders, the engaging portion is engaged in the longitudinal slot, the two shoulders are respectively disposed at opposing sides of the engaging portion, and in a width direction of the sole each of the two shoulders extends beyond the longitudinal slot and shields at least part of the plurality of fasteners.

* * * * *